United States Patent [19]

Yamada

[11] Patent Number: 5,063,820

[45] Date of Patent: Nov. 12, 1991

[54] ELECTRONIC MUSICAL INSTRUMENT WHICH AUTOMATICALLY ADJUSTS A PERFORMANCE DEPENDING ON THE TYPE OF PLAYER

[75] Inventor: Hideo Yamada, Hamamatsu, Japan

[73] Assignee: Yamaha Corporation, Hamamatsu, Japan

[21] Appl. No.: 439,091

[22] Filed: Nov. 20, 1989

[30] Foreign Application Priority Data

Nov. 18, 1988 [JP] Japan ..... 63-292003

[51] Int. Cl.[5] ..... G10H 1/06; G10H 1/18; G10H 1/46

[52] U.S. Cl. ..... 84/609; 84/615; 84/622; 84/633

[58] Field of Search ..... 84/609-615, 84/622-633, 115, 462, 470 R, 477 R, 478, DIG. 7

[56] References Cited

U.S. PATENT DOCUMENTS

| | | | |
|---|---|---|---|
| 4,651,612 | 3/1987 | Matsumoto | 84/470 R X |
| 4,768,413 | 9/1988 | Fujimori | 84/609 |
| 4,953,438 | 9/1990 | Shibukawa | 84/609 |

FOREIGN PATENT DOCUMENTS

| | | |
|---|---|---|
| 53-5545 | 2/1978 | Japan . |
| 59-838 | 1/1984 | Japan . |
| 62-26787 | 7/1987 | Japan . |
| 62-186294 | 8/1987 | Japan . |
| 63-195386 | 12/1988 | Japan . |
| 63-195388 | 12/1988 | Japan . |
| 63-199298 | 12/1988 | Japan . |

*Primary Examiner*—Stanley J. Witkowski
*Attorney, Agent, or Firm*—Spensley Horn Jubas & Lubitz

[57] ABSTRACT

An electronic musical instrument includes a converting device for converting performance information into musical tone control data to generate a musical tone based on conversion data, a storage device for storing the performance information, and an analyzing device for analyzing the performance information to convert the conversion data into adjusted musical tone control data. Accordingly, the performance information is converted into the adjusted musical tone control data based on the conversion data, so that the adjusted musical tone control data automatically generates a suitable magnitude of volume for every player.

10 Claims, 6 Drawing Sheets

ELECTRONIC MUSICAL INSTRUMENT WHICH AUTOMATICALLY ADJUSTS A PERFORMANCE DEPENDING ON THE TYPE OF PLAYER

BACKGROUND OF THE INVENTION

1. Field of the Invention

The present invention relates to an electronic musical instrument which controls tone-generating characteristics depending on performance information, such as key-velocity.

21. Prior Art

Conventional types of electronic musical instrument as disclosed in, for example, Japanese Patent Publication No. 53-5545, detect key-velocity of a key depressed by a player, and converts the key-velocity into tone volume control data based on a touch conversion table stored in a memory. The tone volume control data then controls volumes of musical tones. FIG. 1 shows a characteristic curve of tone volume control data D which changes in accordance with the variation of key-velocity. The characteristic curve shown in FIG. 1 is referred to as a touch curve, hereafter.

It is desirable that the touch curve should change depending on the performance technique, sex, physical strength, and the like, of a player. For example, women generally have less strength than men, thus, the variation of tone volume control data D should have larger values than the variation of tone volume control data D for men.

However, conventional electronic musical instruments only have a few touch curves, so that it is therefore impossible to select a suitable touch curve for every player.

In addition, in the case where a keyboard is connected to a musical tone generating apparatus through a data transferring system as per the MIDI standard (Musical Instrument Digital Interface Standard), in which the musical tone generating apparatus is produced by a different manufacturing company in contrast to the keyboard, the performance of an electronic musical instrument is down graded because a selected touch curve is not valid, resulting in a player being unable to express a feeling adequately in a performance.

Accordingly, the touch curves of the conventional electronic musical instrument are not sufficient to enable a successful performance to be achieved.

Another type of electronic musical instrument has been developed enabling selective setting of a touch curve. However, with this instrument it is difficult to set the touch curve to satisfy a player, and the setting takes much time and skill.

A type of electronic musical instrument in which a touch curve can be selectively set is disclosed in Japanese Patent Publication No. 59-838.

Heretofore, the touch curve has been described by way of an example. But any information relating to player's operation can also be processed similar to the touch data.

SUMMARY OF THE INVENTION

It is accordingly an object of the present invention to provide an electronic musical instrument which can automatically change the conversion characteristics of the touch curve to suit a performance depending on the player.

In an aspect of one embodiment of the present invention, there is provided an electronic musical instrument for generating musical tones based on musical control data, comprising:

performance operation means for outputting performance information in response to a performance by a player; converting means for converting said performance information into musical tone control data determining a characteristic of said musical tone in accordance with a predetermined characteristic of conversion; storage means for storing said performance information; and analyzing means for analyzing said performance information stored in said storage means and for changing said characteristic of conversion in accordance with the analysis result.

Accordingly, performance information generated by the electronic musical instrument is changed into adjusted musical tone control data to generate musical tone, based on the conversion data, so that the adjusted musical tone control data can automatically generate musical tones which are of appropriate magnitude for any player.

DESCRIPTION OF THE PREFERRED EMBODIMENT

Figure 1:
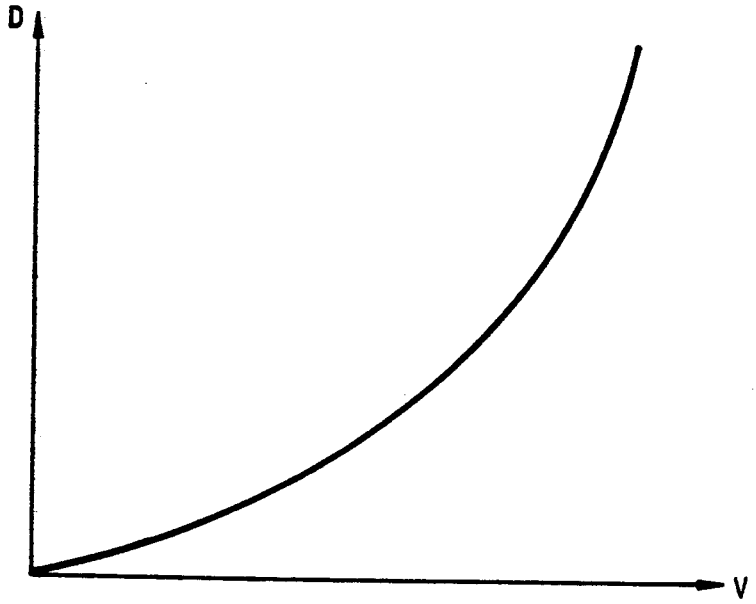
FIG. 1 (PRIOR ART)
FIG. 1 is a graph showing a general relation between touch data V and volume control data D.
Figure 2:
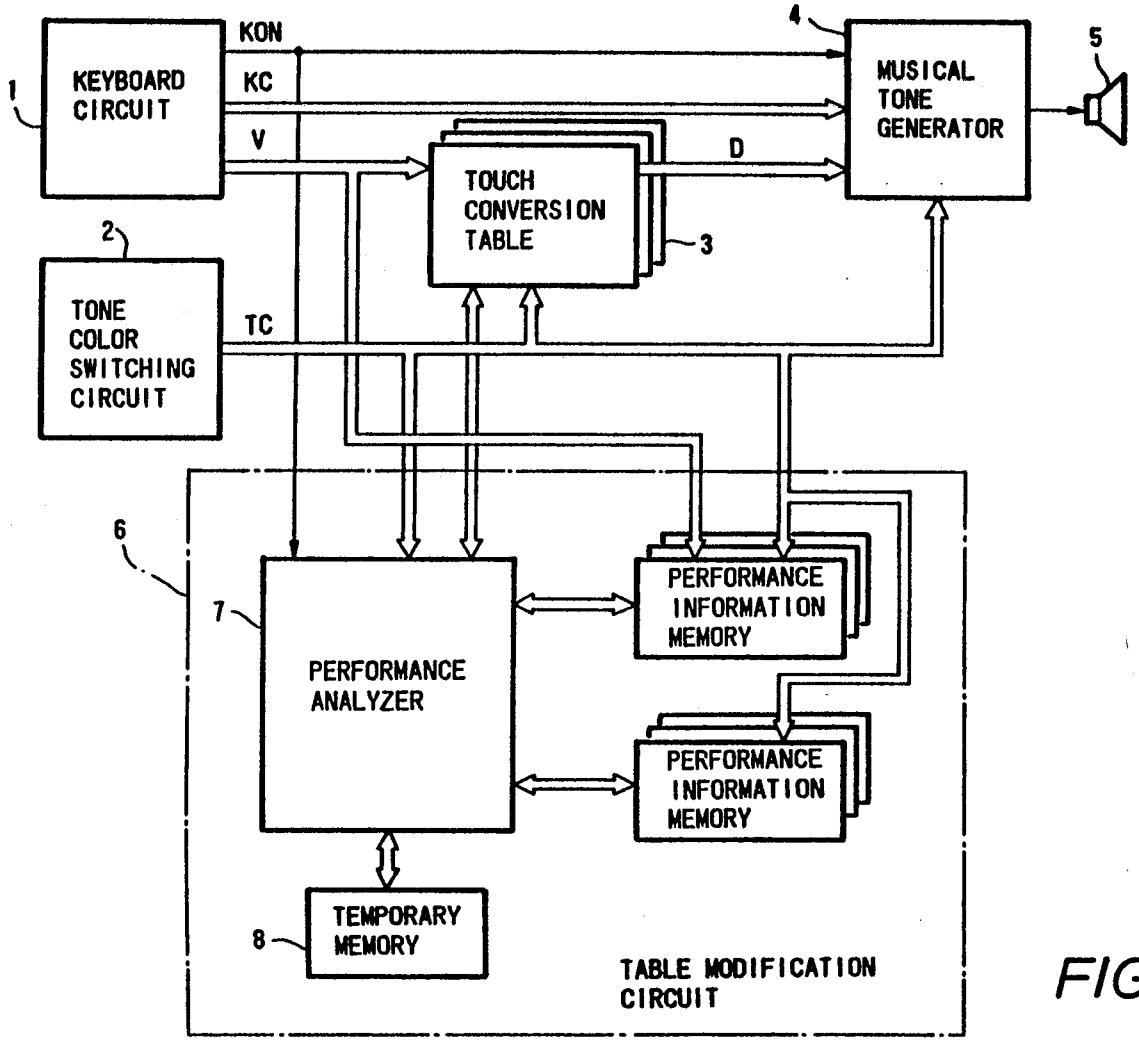
FIG. 2 is a block diagram showing an electronic musical instrument of an embodiment of the present invention.

Hereinafter, an embodiment of the present invention is described with reference to the drawings. FIG. 2 shows a block diagram of a electronic musical instrument in this embodiment.

In this drawing, Numeral 1 designates a keyboard circuit which detects a depressed key of a keyboard. The keyboard circuit 1 outputs key-on signal KON to a musical tone generator 4 and a performance analyzer 7, key-code KC to the musical tone generator 4, and touch data V to a touch conversion table 3 and a performance information memory M1, in which the key-on signal KON indicates a key depressed, the key-code KC indicates a key code of the key depressed, and the touch data V indicates a speed of the key in depressing. The performance information memory M1 and the performance analyzer 7 are incorporated in table modification circuit 6. This table modification circuit 6 is describe later.

Numeral 2 designates a tone color switching circuit which detects an operation of a tone color switch mounted on a control panel The tone color switching circuit 2 outputs tone color code TC corresponding to the tone color switch to the touch conversion table 3, the musical tone generator 4, the performance analyzer 7, and the performance information memories M1 and M2, the performance information memory M2 being also incorporated in the table modification circuit 6.

The touch conversion table 3 is used to convert touch data V supplied from the keyboard circuit 1, into tone volume control data D, which is then supplied to the musical tone generator 4. The touch conversion table 3 comprises a conversion table, each section of which corresponds to one of the tone colors. Each section of the conversion table is selected by its corresponding tone color code TC selected by the tone color switching circuit 2 so as to convert touch data V into tone volume control data D.

A relation between touch data V and tone volume control data D will be described with reference to FIG. 3. In this graph, $V_{10}$ is a maximum value of touch data V, and values of touch data $V_1, V_2 \ldots V_9$ are given by the following equations;

$$V_1=(1/10)V_{10},\ V_2=(2/10)V_{10} \ldots V_9=(9/10)V_{10}$$

The touch conversion table 3 stores tone volume control data $D_1$ to $D_{10}$ corresponding to touch data $V_1$ to $V_{10}$. Accordingly, by supplying touch data $V_1, V_2 \ldots V_{10}$ to the touch conversion table 3, as addresses, to indicate a conversion table, corresponding tone volume control data $D_1, D_2 \ldots D_{10}$ is read from the touch conversion table 3. Actually, there are numerous intermediate touch data values V between touch data values $V_1, V_2 \ldots V_{10}$, and numerous intermediate tone volume control data values D are also stored in the touch conversion table 3 corresponding to touch data values V. In such a case, each of the tone volume control data values D is indicated on the characteristic curve shown in FIG. 3.

Returning to FIG. 2, the musical tone generator 4 generates a musical tone signal which comprises a tone pitch of key-code KC supplied from the keyboard circuit 1, a tone volume of tone volume control data D supplied from the touch conversion table 3, and a tone color of tone color code TC supplied from the tone color switching circuit 2. This musical tone signal is output to a speaker 5.

The table modification circuit 6 changes the touch conversion table 3 into a newly adjusted table suitable for a player. The table modification circuit 6 comprises the performance analyzer 7, the performance information memories M1 and M2, and a temporary memory 8. In such a construction, the performance information memory M1 has storage areas corresponding to each of the tone colors to store, in turn, touch data V corresponding to a key depressed by a player supplied from the keyboard circuit 1, by which one of the storage areas is selected by tone color code TC. The storage area has a storage capacity capable of storing a thousand occurrences of touch data V. The performance information memory M2 also has storage area corresponding to each tone color for storing previous analysis data supplied from the performance analyzer 7, by which one of the storage areas is selected by tone color code TC.

The performance analyzer 7 outputs addresses to the performance information memories M1 and M2 to control the writing and reading of touch data V, and then analyzes the touch data stored in the performance information memory M1 by using the touch data stored in the performance information memory M2, to rewrite the touch conversion table 3 in accordance with the result of the analysis.

A general outline of an operation of the table modification circuit 6 is described as follows. The performance analyzer 7 outputs an address to the performance information memory M1 at every supplying of key-on signal KON for writing touch data V into the performance information memory M1. When a thousand occurrences of touch data V corresponding to a tone color have been written into the performance information memory M1, the touch data is read from the performance information memory M1 to change touch conversion table 3 into a newly adjusted table.

The above operation will be described in accordance with the flow chart shown in FIG. 4.

In step S1, the total number of occurrence of touch data stored in the performance information memory M1 is determined. That is, the number of occurrences of touch data V represented by $C_1, C_2 \ldots C_{10}$ corresponding to touch data $V_0$ to $V_1$, $V_1$ to $V_2$, . . . $V_9$ to $V_{10}$ is determined by examining all the touch data stored in the performance information memory M1. The result of the numbers is written into the temporary memory 8. The number of occurrences of touch data V corresponding to $C_1$ to $C_{10}$ is shown by a characteristic curve L1 in FIG. 5.

In step S2, tone volume control data $D_1, D_2 \ldots D_{10}$ is read successively from the touch conversion table 3 for writing into the temporary memory 8.

In step S3, a counter "n" is set to "1".

In step S4, a calculation is carried out in accordance with the following equation;

$$C_n-C_n'=E_n \quad (1)$$

where $C_n'$ is a number of occurrences of data determined from the previous aggregation process. This number has been written into the performance information memory M2. $E_n$ is a difference of frequency of occurrence of data. A characteristic curve L1' indicates the number of occurrences $C_n'$ as shown in FIG. 4.

In step S5, the process decides whether the difference $E_n$ is positive or not. If the decision is "yes", the process moves to step S6, otherwise it moves step S7.

In step S6, a calculation is carried out in accordance with the following equation to obtain a compensation value $$\log[10+S\{(C_n+C_n')/(N+N')\}(C_n/C_n')]=X_n \quad (2)$$

where S is a constant previously set by a player, N is the number of occurrences of touch data (1000 in this embodiment) written into the performance information memory M1, and N' is the previous number of occurrences of touch data (1000 in this embodiment) written into the performance information memory M1.

In step S7, the process decides whether the difference $E_n$ is negative or not. The difference $E_n$ has already been calculated in step S4. If the decision is "yes" ($E_n<0$), the process moves to step S8, otherwise ($E_n=0$) it moves step S9.

In step S8, a calculation is carried out in accordance with the following equation to obtain a compensation value $X_n$;

$$1/\log[10+S\{(C_n+C_n')/(N+N')\}(C_n'/C_n)]=X_n \quad (3)$$

In step S9, the value of $X_n$ is set to "1", then the process moves to step S10.

In step S10, in the case where the tone volume control data stored in the temporary memory 8 is $D_n$, $D_{n+1}$, and compensation value $X_n$ is used, calculation is carried out in accordance with the following equation;

$$X_n(D_{n+1}-D_n)+D_n=DA_{n+} \quad (4)$$

In the case where the tone volume control data stored in the temporary memory 8 is $D_{n+1}-D_n=0$, calculation is carried out according to the following equation;

$$(X_n)(D_n)=DA_{n+1} \quad (5)$$

In step S11, data $DA_{n+1}$ is written into the temporary memory 8.

In step S12, tone volume control data $D_{n+2}$ to $D_{10}$ is shifted by a value "d" which is given by the following equation;

$$DA_{n+1}+D_{n+1}=d \quad (6)$$

that is, tone volume control data D is shifted as follows;

$$D_{n+2}+d \rightarrow D_{n+2}$$
$$D_{n+3}+d \rightarrow D_{n+3}$$
$$\vdots$$
$$D_{10}+d \rightarrow D_{10}$$

In step S13, the counter "n" is incremented by "1".

In step S14, the process decides whether the counter "n" is equal to 10 or not. If the decision is "no", the process returns to step S4 to repeat the above processes, otherwise it moves to step S15.

In the above description, the difference between the present number of occurrences $C_n$ and the previous number of occurrences $C_n'$, that is, the difference $E_n$ (shown in FIG. 5) is determined for touch data from $V_{n-1}$ to $V_n$ in step S4. Then, assuming that the difference $E_n$ is positive, an inclination of the characteristic curve is increased for the touch data from $V_n$ to $V_{n+1}$ as shown in FIG. 3. While the difference $E_n$ is negative, the inclination is decreased. More details of the above will described with reference to FIG. 6. FIG. 6 is a partially enlarged view of the characteristic curve shown in FIG. 3. Assuming that the difference $E_n$ is positive, the inclination of characteristic curve is increased, as shown by a broken line. While the difference $E_n$ is negative, the inclination of the characteristic curve is decreased, as shown by a chain line. In such cases, the magnitude of the inclination is determined by the compensation value $X_n$ which is calculated by equation (2) or (3).

For example, if the values of N and S in equation (2) or (3) are set to the following; $N=N'=1000$, and $S=25$, and $C_n=200$, and $C_n'=100$. Then in this case, since $C_n>C_n'$ equation (2) is used to determine compensation value $X_n$ as follows;

$$X_n=\log[10+25\{(200+100)/(1000+1000)\}(200/100)]=\log 17.5=1.24$$

As a result, the inclination of the characteristic curve is increased by 24%.

On the other hand, for example, if the number of occurrences of data $C_n$ and $C_n'$ are set to the following; $C_n=100$ and $C_n'=200$. Then in this case, since $C_n<C_n'$ equation (3) is used to determine compensation value $X_n$ as follows;

$$X_n 1/\log 17.5=1/1.24=0.8$$

As a result, the inclination of the characteristic curve is decreased by 20%.

Furthermore, if the number of occurrences of data $C_n$ and $C_n'$ are set to $C_n=20$ and $C_n'=10$, the compensation value $X_n$ is determined as follows;

$$X_n=\log\{10+25(30/2000)(20/10)\}=\log 10.75=1.03$$

In this case, the inclination of the characteristic curve is increased by 3%.

In the above calculations, though the ratio of $C_n/C_n'$ is the same value, the inclination of the characteristic curve is decreased by little value if the number of occurrences of touch data $V_n$ is small. Thus, by compensating the inclination of the characteristic curve in accordance with the compensation value of $X_n$ from equation (2) or (3), both the difference in the number of occurrences of touch data $V_n$ and the magnitude of the number of occurrences of touch data $V_n$ can be represented by the characteristic curve and a more reliable and accurate characteristic curve obtained. Furthermore, the magnitude of the compensation value can also be adjusted by changing the value of S in equations (2) and (3).

In the above calculations, when the difference $E_n$ is "0", that is, the number of occurrences of touch data V is not changed between the previous number and the present number, compensation value $X_n$ becomes "1" (shown by step S9), and the inclination of the characteristic curve is not changed.

Figure 7:
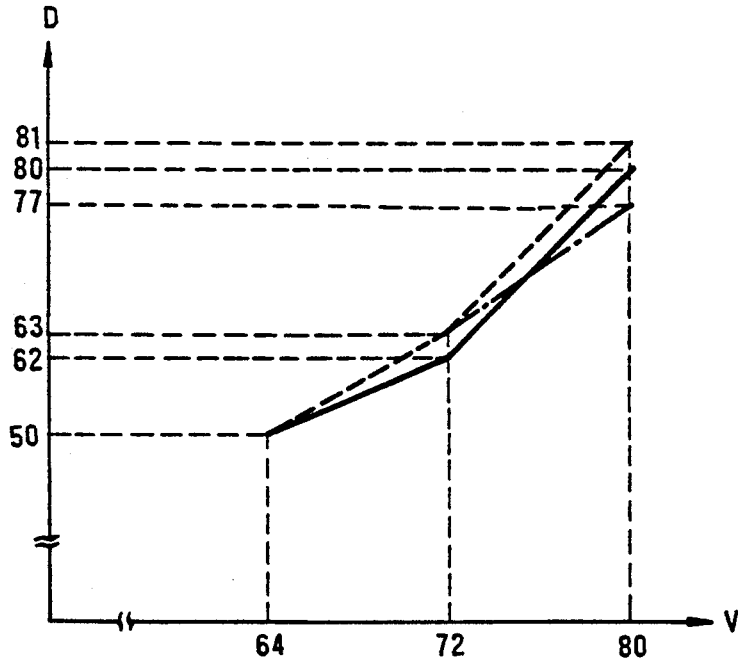
FIG. 7 is a graph showing another characteristic curves representing operations of the electronic musical instrument.

Tone volume control data $D_{n+1}$ is changed in accordance with compensation value $X_n$, that is, tone volume control data $DA_{n+1}$ (shown by step S10) is determined by equation (4). An example is shown in FIG. 7.

The values are set to the following;

$$V_n=64,\ D_n=50,\ \text{and}$$

$$V_{n+1}=72,\ D_{n+1}=62.$$

when $C_n=75$ and $C_n'=50$, and also provided that $N=N'=1000$, and $S=25$, compensation value $X_n$ is determined by equation (2) in accordance with the above calculation and as a result, $X_n=1.09$. Thus, a newly adjusted tone volume control data is calculated by;

$$DA_{n+1}=1.09(62-50)+50=63$$

Next, this determined tone volume control data $DA_{n+1}$ is written into the temporary memory 8 to replace the previous tone volume control data $D_{n+1}$.

Figure 4:
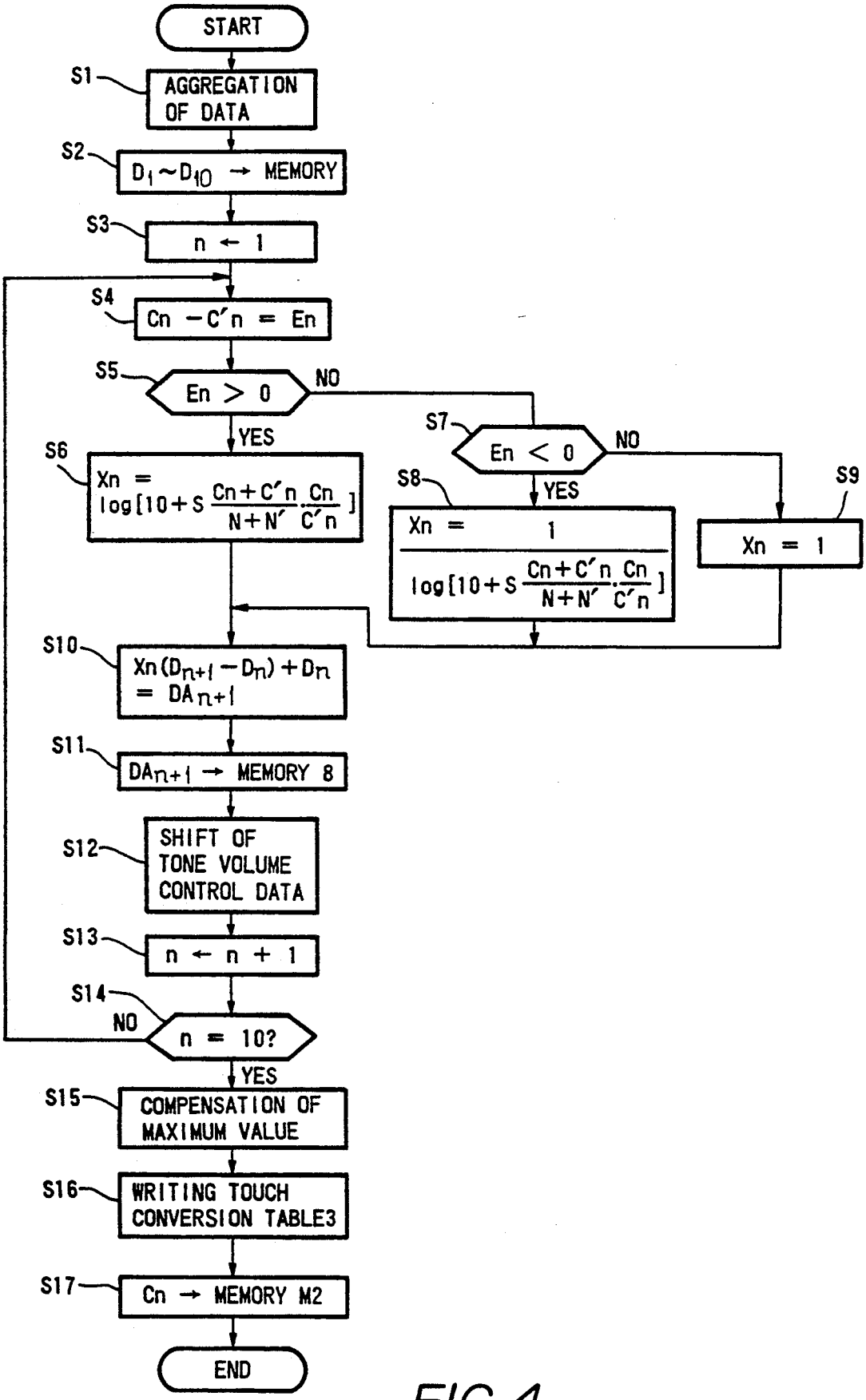
FIG. 4 is a flow chart of an operation of the electronic musical instrument.

Then, as shown in FIG. 6, the characteristic curve from touch data $V_{n+1}$ to subsequent touch data is shifted in parallel, that is, the shift process for tone volume control data $D_{n+2}$ to $D_{10}$ is carried out, as described for step S12 shown in FIG. 4. FIG. 7 shows the result of the shift process. That is, tone volume control data $D=80$ is shifted in relation to touch data $V=80$, so that the tone volume control data becomes $D=81$ as shown a broken line.

Accordingly, the above process is repeatedly carried out, and then the next process after the above process is carried out as follows;

The values of touch data V and tone volume control data D are set as;

$V_{n+1}=72$, $D_{n+1}=63$, and $V_{n+2}=80$, $D_{n+2}=81$.

Then when $C_{n+1}=20$, and $C_{n+1}'=100$ compensation value $X_n$ can be determined by equation (3) giving, $X_n=0.8$. Thus, the tone volume control data is given by;

$DA_{n+2}=77$ (referring to the chain line shown in FIG. 7)

Figure 8:
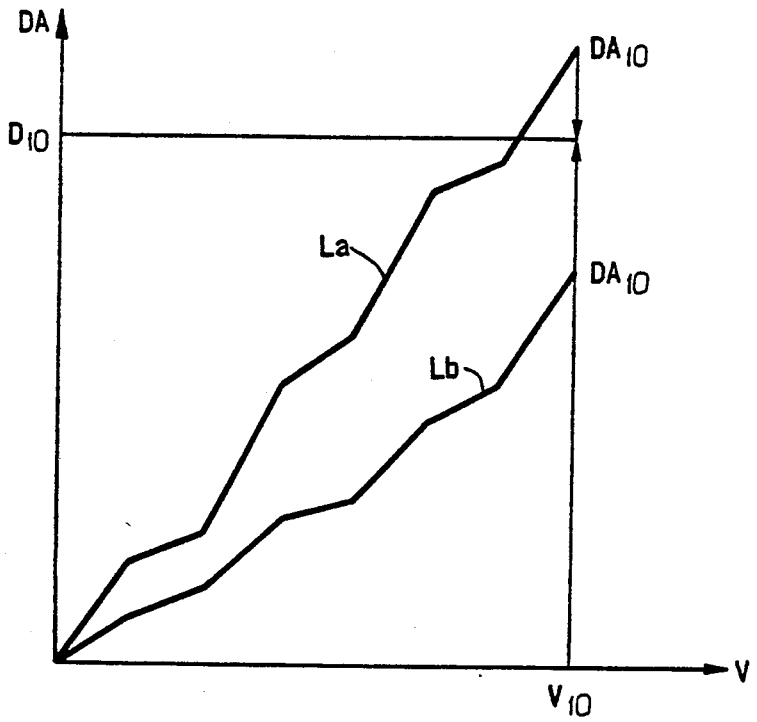
FIG. 8 is a graph showing another characteristic curves representing operations of the electronic musical instrument.

In step S15, a compensation is carried out for the maximum value in relation to the touch data and tone volume control data. That is, when the inclination of the characteristic curve is changed in accordance with the above processes, the newly adjusted tone volume control data $DA_{10}$ either is more than a maximum value $D_{10}$ which occupies a predetermined number of bits for indicating the tone volume control data, or it is less than the maximum value, as shown by La and Lb in FIG. 8. Because of this, the process in step S15 is carried out to harmonize the maximum value $DA_{10}$ of the newly adjusted tone volume control data with maximum value $D_{10}$. That is, the following calculation is carried out for all newly adjusted tone volume control data $DA_n$ stored in temporary memory 8;

$$(DA_n)(D_{10}/DA_{10}) \rightarrow DA_n$$

As a result, maximum value $DA_{10}$ of the newly adjusted tone volume control data DA is harmonized with maximum value $D_{10}$.

In step S16, linearly interpolated data is determined for a plurality of newly adjusted tone volume control data $DA_1$, $DA_2 \ldots DA_{10}$ stored in the temporary memory 8, then the linearly interpolated data and the new tone volume control data $DA_1$ to $DA_{10}$ is written into the touch conversion table 3.

In step S17, the number of occurrences of data $C_n$ stored in the temporary memory 8 is written into the performance information memory M2 to replace the number of occurrences of data $C_n'$.

Accordingly, in the electronic musical instrument, touch data V is always written into the performance information memory M1. When a thousand occurrences of touch data V with respect to one tone color is written into the performance information memory M1, all touch data is read out for analysis. The touch conversion table 3 is then rewritten in accordance with the result of the analysis. As a result, the rewritten touch conversion table 3 is set in the most suitable for a player automatically.

In this embodiment, the table reforming process is carried out when a thousand occurrences of touch data V have been written into the performance information memory M1, however, the number of occurrences of touch data V is not limited to a thousand. Another number of occurrences of touch data V more or less than a thousand is acceptable.

A logarithm is used in equations (2) and (3) to make the inclination of the characteristic curve smooth.

In the above embodiment, touch data V is recorded for every tone color, but this touch data can be recorded independent of the tone color. That is, the touch data V can be recorded for, e.g. every player of the keyboard, or every group of keys of the keyboard, or every keyboard in the case of an electronic musical instrument having a plurality of keyboards.

Furthermore, in the above embodiment, the table modification process compares the present touch data with the previous touch data, but this modification process can use standard touch data in comparison with the present touch data, in which the standard touch data being prestored in a memory.

In addition, an average value of the touch data can be determined for the old touch data which includes data from a beginning up to the previous touch data. Then the modification process can compare the present touch data with the average value of the touch data.

In the above embodiment, the modification process is carried out based on the number of occurrences of touch data V. However, if touch data V is represented such as in a probability distribution, then the modification process can be carried out based on this distribution of the touch data V.

The analysis of the touch data is not limited to that in the above description, and many types of analysis can be used in this case. Therefore, another equation of relationships can be used instead of equations (2) and (3). Also, a plurality of analyzed algorithms can be stored in a memory, so that the touch data can be analyzed by selecting respective algorithms. Moreover, a method using artificial intelligence can be used to analyze the touch data.

Furthermore, in the above embodiment, the maximum value in relation to the touch data and tone volume control data is compensated in step S15 as shown in FIG. 4. However, instead, when the newly adjusted tone volume control data $DA_n$ exceeds maximum value $D_{10}$, that is, the data is saturated, all the newly adjusted tone volume control data $DA_n$ can be replaced by the maximum value $D_{10}$. On the other hand, when the newly adjusted tone volume control data $DA_n$ does not exceed maximum value $D_{10}$, the new tone volume control data $DA_n$ can be used as it is in this analysis.

When the number of occurrences $C_n$ of touch data V exceeds a previous number, the inclination of the characteristic curve of touch conversion table 3 is increased in the embodiment. Conversely, the inclination of the characteristic curve can be decreased when the number of occurrences $C_n$ of touch data V exceeds the previous number.

Figure 3:
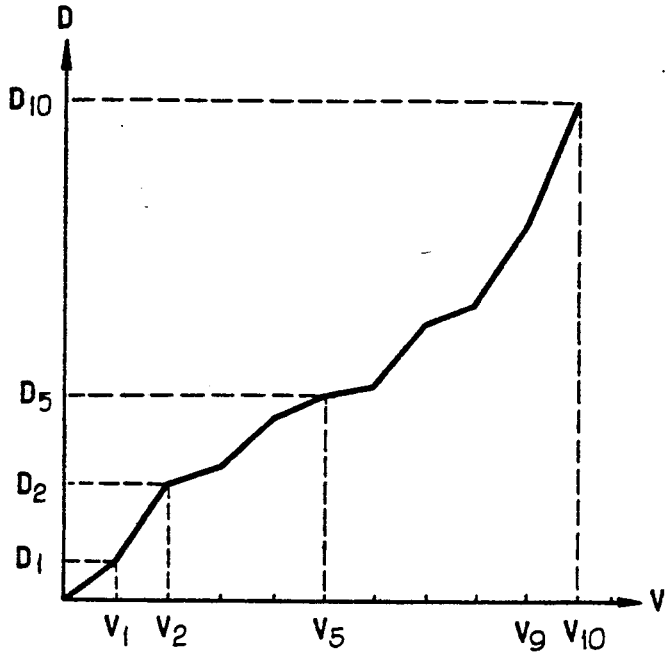
FIG. 3 is a graph showing a characteristic curve of a touch conversion table.
Figure 5:
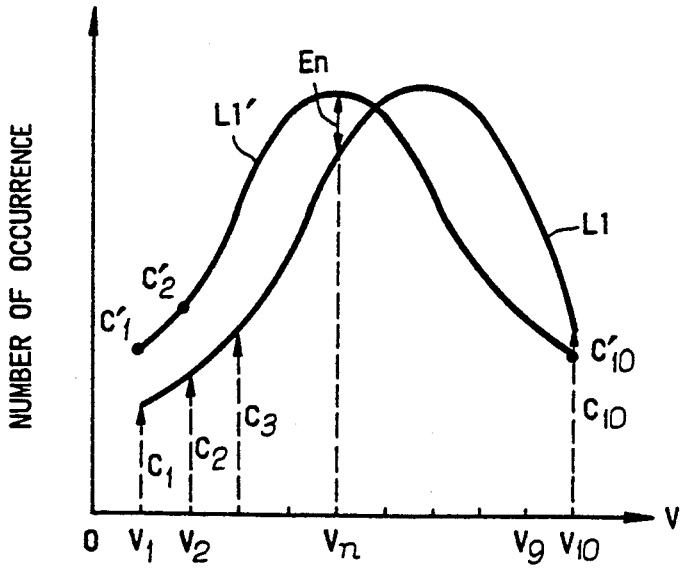
FIG. 5 is a graph showing a characteristic curves representing operations of the electronic musical instrument.
Figure 6:
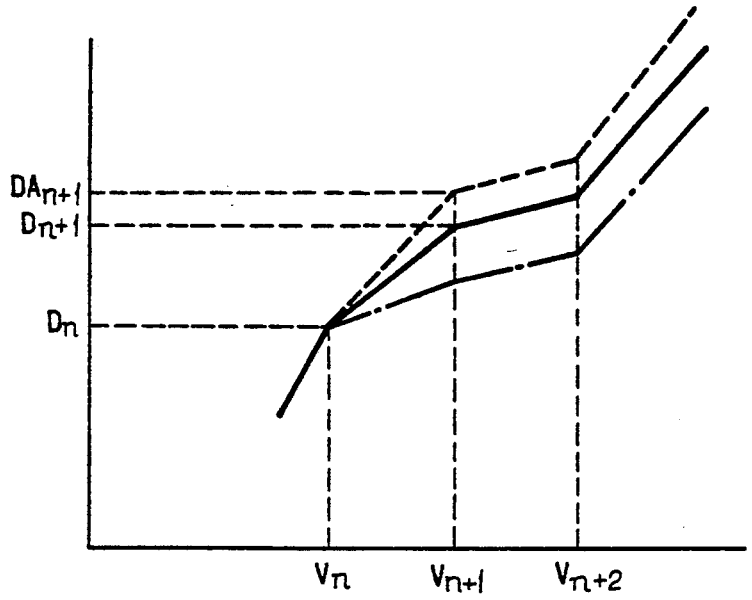
FIG. 6 is a graph showing another characteristic curves representing operations of the electronic musical instrument.

The characteristic curve shown in FIG. 3 and the number of occurrences of data shown in FIG. 5 can be displayed on a display apparatus to evaluate a habit and/or a performance of a player, or the like.

In the embodiment, touch conversion table 3 is changed by an automatic process, however, other musical tone control data for controlling tone volume, tone color, tone pitch, modulation signal, and the like can be automatically changed based on the number of occurrences of the touch data.

The present invention can be utilized for a rhythm machine which generates a rhythm sound by a drumpad.

The present invention can also be utilized for a musical instrument which comprises a keyboard portion and a musical tone generating portion separated from the keyboard, in which both portions are in communication with communication data as per MIDI Standard (Musical Instrument Digital Interface Standard), or the like, instead of an electronic musical instrument incorporating the keyboard together with the musical tone generating portion The preferred embodiment described herein is to be considered as merely illustrative; the scope of the invention is intended to be indicated by the appended claims and all variations which fall within the claims are intended to be embraced therein.

What is claimed is:

1. An electronic musical instrument for generating a musical tone comprising:

performance operation means for outputting performance information in response to a performance by a player;

converting means for converting said performance information into musical tone control data, the converting means determining a characteristic of said musical tone in accordance with a first characteristic of conversion;

storage means for storing a predetermined portion of said performance information;

calculating means for calculating a second characteristic of conversion in accordance with the predetermined portion of the performance information stored in the storage means, and control means for controlling the converting means to determine the characteristic of the musical tone in accordance with the second characteristic of conversion.

2. An electronic musical instrument for generating a musical tone based on musical tone control data, comprising:

performance operation means for outputting performance information in response to a performance by a player;

a plurality of converting means for converting, in accordance with a first selected conversion characteristic, the performance information into musical tone control data which determines a characteristic of the musical tone;

selecting means for selecting a converting means from among said plurality of converting;

storage means for storing a predetermined portion of the performance information;

calculating means for calculating a second selected conversion characteristic in accordance with the predetermined portion of the performance information stored in the storage means, and control means for controlling the converting means to determine the characteristic of the musical tone in accordance with the second selected characteristic of conversion.

3. An electronic musical instrument according to claim 1 or 2 wherein said performance operation means comprises a keyboard having a key.

4. An electronic musical instrument according to claim 1 or 2 wherein said converting means comprises a conversion table determining the relation between said musical tone control data and said performance information.

5. An electronic musical instrument according to claim 3 wherein said performance operation means outputs touch data representing a degree of depression of said key as said performance information, and said converting means comprises a touch conversion table determining the relation between said musical tone control data and said touch data.

6. An electronic musical instrument according to claim 1 or 2 wherein said musical tone control data determines at least one of tone volume, a tone color, a tone pitch, and an effect of said musical tone.

7. An electronic musical instrument according to claim 1 or 2 wherein said analyzing means has a memory means for storing said analysis result.

8. An electronic musical instrument for generating a musical tone comprising:

keyboard means having a plurality of keys for outputting performance information in response to an operation of one of the plurality of keys by a player, the performance information including touch data representing a characteristic of the operation of the key by the player;

converting means for converting said performance information into musical tone control data, the converting means determining a characteristic of said musical tone in accordance with a first characteristic of conversion;

storage means for storing a predetermined portion of said performance information;

calculating means for calculating a second characteristic of conversion in accordance with the predetermined portion of the performance information stored in the storage means, and control means for controlling the converting means to determine the characteristic of the musical tone in accordance with the second characteristic of conversion.

9. An electronic musical instrument according to claim 8, wherein the touch data represents the touch velocity of the operated key.

10. An electronic musical instrument according to claim 9, wherein the touch data represents a degree of depression of the operated key.

* * * * *